US006431677B1

(12) United States Patent
Anderson et al.

(10) Patent No.: US 6,431,677 B1
(45) Date of Patent: Aug. 13, 2002

(54) PRINT HEAD DRIVE SCHEME

(75) Inventors: Frank Edward Anderson, Sadieville; George Keith Parish, Winchester, both of KY (US)

(73) Assignee: Lexmark International, Inc, Lexington, KY (US)

( * ) Notice: Subject to any disclaimer, the term of this patent is extended or adjusted under 35 U.S.C. 154(b) by 102 days.

(21) Appl. No.: 09/589,828

(22) Filed: Jun. 8, 2000

(51) Int. Cl.[7] ..... B41J 29/38; B41J 2/05
(52) U.S. Cl. ..... 347/12; 347/58
(58) Field of Search ..... 347/12, 60, 56–59, 347/50

(56) References Cited

U.S. PATENT DOCUMENTS

| | | | | |
|---|---|---|---|---|
| 3,686,678 | A | 8/1972 | Robbins et al. | 345/74 |
| 4,216,480 | A | 8/1980 | Buehner et al. | 347/74 |
| 4,528,572 | A | 7/1985 | Sasaki et al. | 347/182 |
| 4,578,689 | A | 3/1986 | Spencer et al. | 347/129 |
| 4,683,479 | A | 7/1987 | Horiya et al. | 347/188 |
| 4,719,477 | A | 1/1988 | Hess | 347/59 |
| 4,814,790 | A | 3/1989 | Nitta | 347/175 |
| 4,887,098 | A | 12/1989 | Hawkins et al. | 347/58 |
| 4,893,133 | A | 1/1990 | Ohmori et al. | 347/182 |
| 5,028,812 | A | 7/1991 | Bartky | 307/246 |
| 5,057,855 | A | 10/1991 | Damouth | 347/57 |
| 5,081,474 | A | 1/1992 | Shibata et al. | 347/59 |
| 5,089,831 | A | 2/1992 | Ito et al. | 347/182 |
| 5,103,246 | A | 4/1992 | Dunn | 347/58 |
| 5,117,374 | A | 5/1992 | Goetz | 364/559 |
| 5,122,812 | A | 6/1992 | Hess et al. | 347/59 |
| 5,146,236 | A | 9/1992 | Hirata et al. | 347/12 |
| 5,541,629 | A | 7/1996 | Saunders et al. | 347/12 |
| 5,568,171 | A | 10/1996 | Keefe et al. | 347/58 |
| 5,598,189 | A | 1/1997 | Hess et al. | 347/9 |
| 5,600,353 | A | 2/1997 | Hickman et al. | 347/43 |
| 5,610,638 | A | 3/1997 | Courtney | 347/14 |
| 5,644,342 | A | 7/1997 | Argyres | 347/12 |
| 5,648,805 | A | 7/1997 | Keefe et al. | 347/65 |

FOREIGN PATENT DOCUMENTS

| | | | | |
|---|---|---|---|---|
| JP | 41027827 | A * | 11/1998 | B41J/2/05 |

* cited by examiner

*Primary Examiner*—John Barlow
*Assistant Examiner*—Alfred E Dudding
(74) *Attorney, Agent, or Firm*—Luedeka, Neely & Graham

(57) ABSTRACT

The invention provides a three-dimensional printhead drive scheme for a printhead of an ink jet printer. A method is provided for selectively activating a printing element within an array of printing elements on a printhead of an ink jet printer. The printhead includes an integrated circuit having pass-gate devices and power devices associated with corresponding printing elements. The pass-gate devices and power devices each have a source, drain, and gate, where the source of each pass-gate device is connected to the gate of a corresponding one of the power devices, and where the source of each power device is connected to a corresponding one of the printing elements. According to the method, a quadrant selection signal is provided to a subset of the pass-gate devices, and the subset of printing elements within the array of printing elements is selected based on the quadrant selection signal. An address signal is provided to a group of the power devices within the subset, and the group of printing elements is selected based on the address signal. A primitive signal is provided to the selected group of printing elements on the printhead, and a printing element within the selected group is activated based on the primitive signal.

20 Claims, 8 Drawing Sheets

PRINT HEAD DRIVE SCHEME

TECHNICAL FIELD

The invention relates generally to ink jet printers. More particularly, the invention relates to an improved method and apparatus for addressing nozzles in an inkjet printhead through address lines, quadrature lines and primitive lines.

BACKGROUND OF THE INVENTION

An ink jet print head cartridge has a number of nozzles on a printhead that are used to expel drops of ink onto a printing surface. As the printhead cartridge body scans across a printing surface at a predetermined speed, the nozzles on the printhead are fired at precisely determined times to expel drops of ink and produce an image on the printing medium. Due to design constraints, an ink jet printhead can only fire a certain number of nozzles in a given amount of time. Thus, the time required to print an image is fixed by the rate at which the printhead can fire the nozzles. One way to decrease the time required to print an image with an ink jet printer is to address and fire an increased number of nozzles in a given amount of time as the ink jet printhead cartridge body moves across the page to be printed. However, for any given clock rate, more input data lines are required to address and fire an increased number of nozzles in a fixed amount of time. Unfortunately as the number of input lines to the ink jet printhead increases, so does the cost and complexity of manufacturing the printhead. Thus, increasing the number of data lines leads to a more expensive printhead that is capable of firing more nozzles in a fixed amount of time.

Typically, printing a higher resolution image requires more nozzle firings per unit area than does printing a lower resolution image. One way to increase the number of nozzle firings per unit area is to fire more nozzles in a fixed amount of time as the printhead cartridge body passes over the printing medium as discussed above. However, a low cost alternative for printing a higher resolution image is to have the ink jet printhead cartridge body make multiple passes over the same print region. For example, if a printhead can fire all of its nozzles simultaneously, it can print a full resolution image in one pass. However, if the printhead only has enough address lines to fire one quarter of the nozzles in one pass, the printhead will have to make four passes before printing a full resolution image. Thus, the number of address lines required to print an image can be decreased by having the ink jet printhead cartridge body make multiple passes over the printing region. While such a printhead drive scheme allows an image to be printed with a decreased number of address lines, the time required to print the image is increased. Thus, having the ink jet printhead cartridge body make multiple passes is a low cost alternative for minimizing the number of address lines to the ink jet printhead.

Prior three-dimensional addressing techniques provide an addressing dimension by switching the ground connection at the drain of the power FET. Switching the ground increases the impedance losses in the heater resistor path, which requires a higher voltage be used to maintain the same energy delivered to the heater. The higher voltage makes greater demands on the voltage breakdown requirements of the heater chip logic. Further, additional active devices in the heater path increase the variance in the energy delivered to the heater which results in poor print quality.

What is needed, therefore, is a three-dimensional addressing scheme that does not require ground switching and thereby does not require a high voltage driver.

SUMMARY OF THE INVENTION

The foregoing and other needs are met by an improved printhead drive scheme for activating printing elements on a printhead of an ink jet printer. The invention provides a method of selectively activating a printing element within an array of printing elements on a printhead of an ink jet printer. The method is used with a printhead that includes pass-gate devices and power devices associated with corresponding printing elements. The pass-gate devices and power devices each have a source, drain, and gate, where the source of each pass-gate device is connected to the gate of a corresponding one of the power devices, and where the source of each power device is connected to a corresponding one of the printing elements. According to the method, a quadrant selection signal is provided to a subset of the pass-gate devices, and a subset of printing elements are identified in the array of printing elements based on the quadrant selection signal. An address signal is provided to a group of the power devices, and a group of printing elements is identified within the subset of printing elements based on the address signal. A primitive signal is provided to the group of printing elements on the printhead, and a printing element is activated within the group based on the primitive signal.

In another aspect, the invention provides an ink jet printing apparatus for generating a printed image on a print medium. The apparatus includes an array of resistive heating elements for heating adjacent ink and thereby causing the ink to be expelled onto the print medium. A subset selection circuit selects subsets of the resistive heating elements to be activated based on subset selection signals. A group selection circuit selects groups of the resistive heating elements within a selected subset to be activated based on group selection signals. A primitive selection circuit provides primitive selection signals to resistive heating elements within a selected group, where the primitive selection signals activate individual resistive heating elements within the selected group. The apparatus also includes power switching devices for controlling activation of corresponding resistive heating elements based on the group selection signals, and pass switching devices for providing the group selection signals to corresponding power switching devices based on the subset selection signals.

The above discussed method and apparatus for addressing and activating the resistive heating elements of an ink jet printhead allow for a greater number of resistive heating elements to be addressed and activated with a reduced number of data lines running between the printhead and the printer controller. Reducing the number data lines decreases the complexity and the production cost of the ink jet printhead. Since most ink jet printhead assemblies are designed to be disposable, a method and apparatus which reduces their cost represents a substantial improvement over the prior art.

The invention further provides a three dimensional addressing scheme that does not require ground switching in order to address the third dimension of circuitry elements. The integrated circuit on the printhead utilizes a pass gate design to switch on/off a power FET in the current path of the heater resistor. The address lines are connected to the drain side of the pass device, and the quad lines are connected to the gate of the same pass device. The source of the pass device is used to drive the gate of the power FET connected to the heater resistor. Thus, when the address, quad, and primitive lines for a particular heater resistor are all high, the resistor is energized. This technique provides three-dimensional addressing without switching the ground at the power FET drain.

BRIEF DESCRIPTION OF THE DRAWINGS

Further advantages of the invention will become apparent by reference to the detailed description when considered in conjunction with the figures, wherein like reference numbers indicate like elements through the several views, and wherein.

to FIG. 1 is a functional block diagram of a printer controller providing control signals to a printhead, according to a preferred embodiment of the invention.

DETAILED DESCRIPTION OF THE INVENTION

Figure 1:
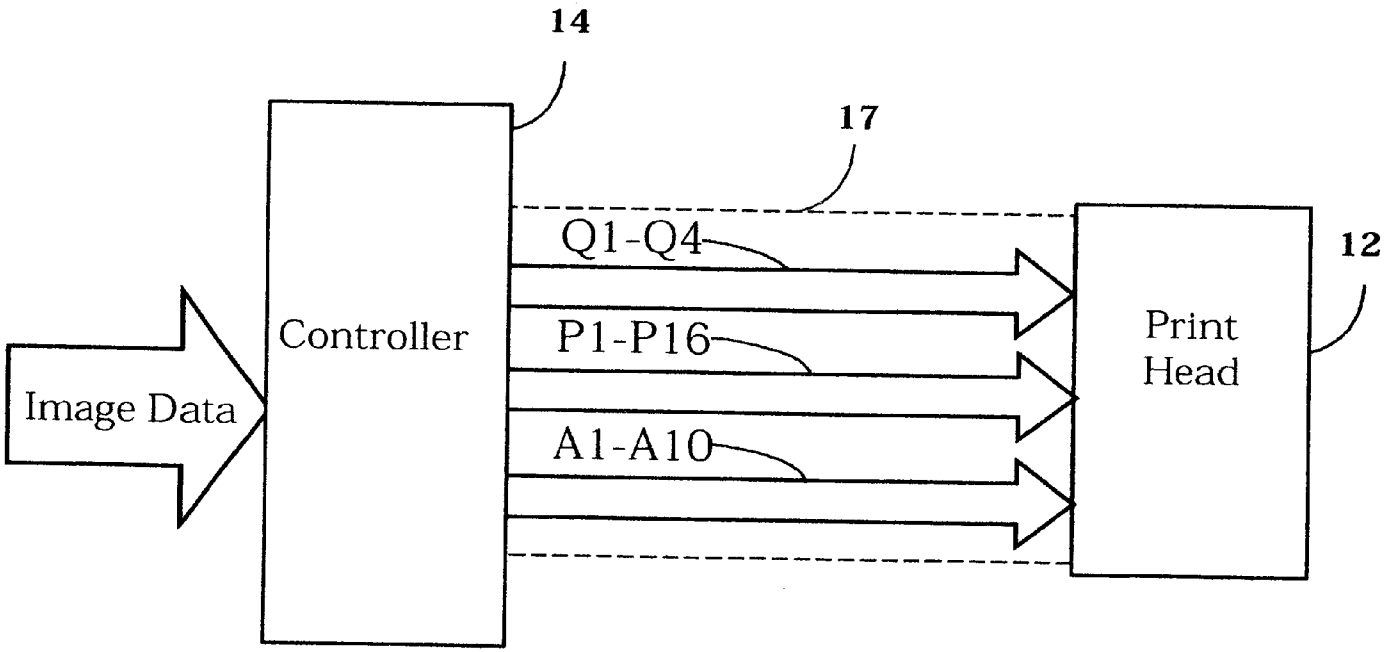
Figure 2:
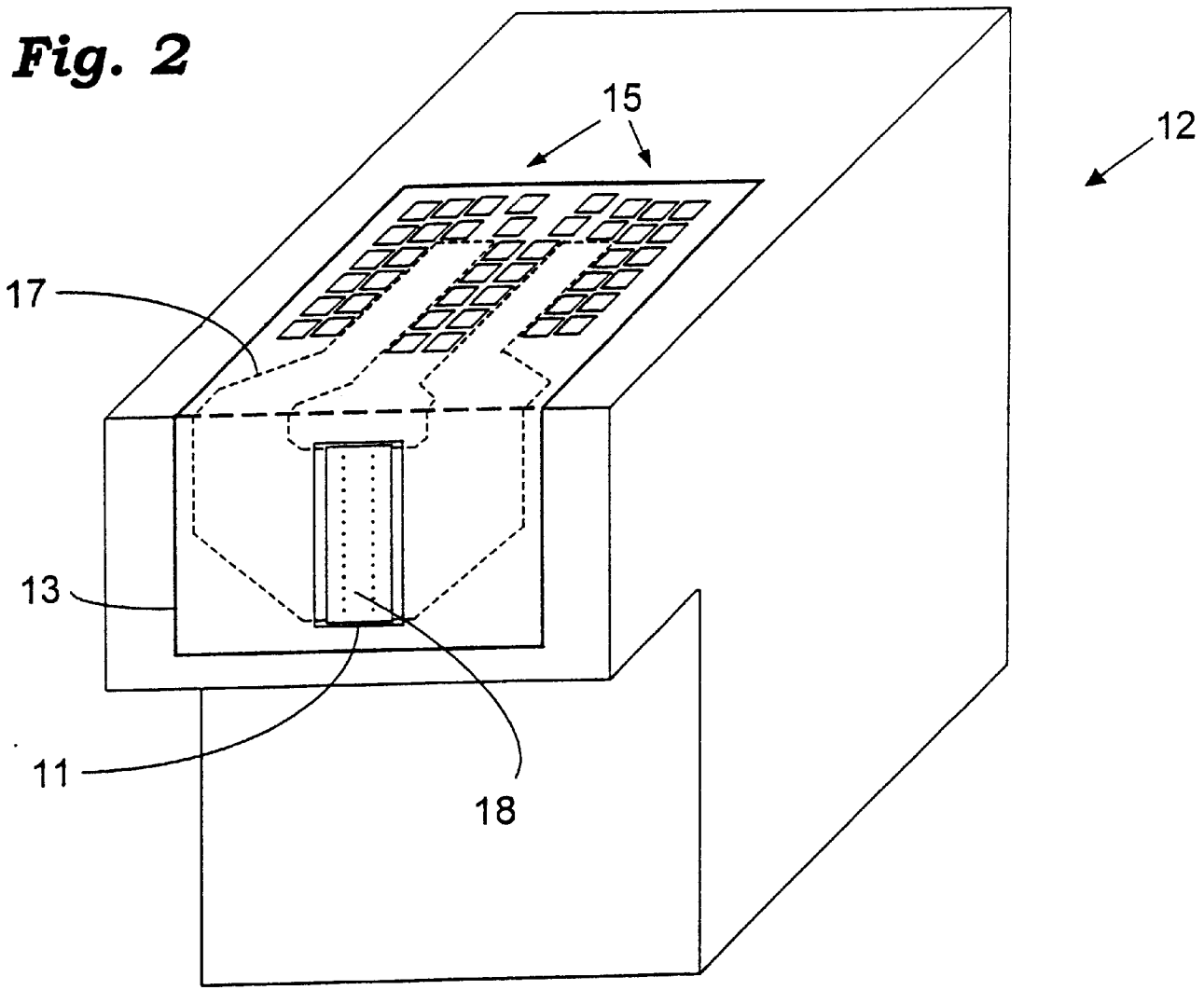
FIG. 2 is a perspective view of a printhead, according to a preferred embodiment of the invention.

With reference generally to FIGS. 1–3B, an integrated control circuit 10 is located on a heater chip 11 of a printhead 12. The chip 11 is included in a tape automated bonding (TAB) circuit 13. The integrated circuit 10 on the chip 11 includes an array of resistive heating elements R1–R640 and associated enabling circuitry. As will be discussed in detail below, the enabling circuitry according to the present invention includes a number of pass gate devices, also referred herein as pass switching devices, PG1–PG640, power gate devices, also referred herein as power switching devices, D1–D640, pull down circuits, also referred herein as pull switching circuits, PD1–PD640. The control circuit 10 communicates with the printer controller 14 via a set of control lines: address lines A1–A10, quadrature or quad lines Q1–Q4, and primitive control lines P1–P16. The TAB circuit 13 is electrically connected to the control lines Q1–Q4, A1–A10, and P1–P16 through a number of TAB contacts 15 located on the TAB circuit 13. A number of conductors, which lie generally within the dashed outline area 17 of FIG. 1, electrically connect the TAB circuit contacts 15 with the integrated control circuitry 10 located on chip 11. The pass switching devices PG1–PG640, power switching devices D1–D640, and pull down circuits PD1–PD640, perform switching operations based on signals provided to each device, as discussed in more detail below. Each resistive heating element R1–R640 is associated with a corresponding inkjet nozzle 18 in a printhead nozzle plate. Preferably the resistive heating elements R1–R640 are thin film metal resistors having a resistance of between about 25 ohms and about 40 ohms.

Figure 3A:
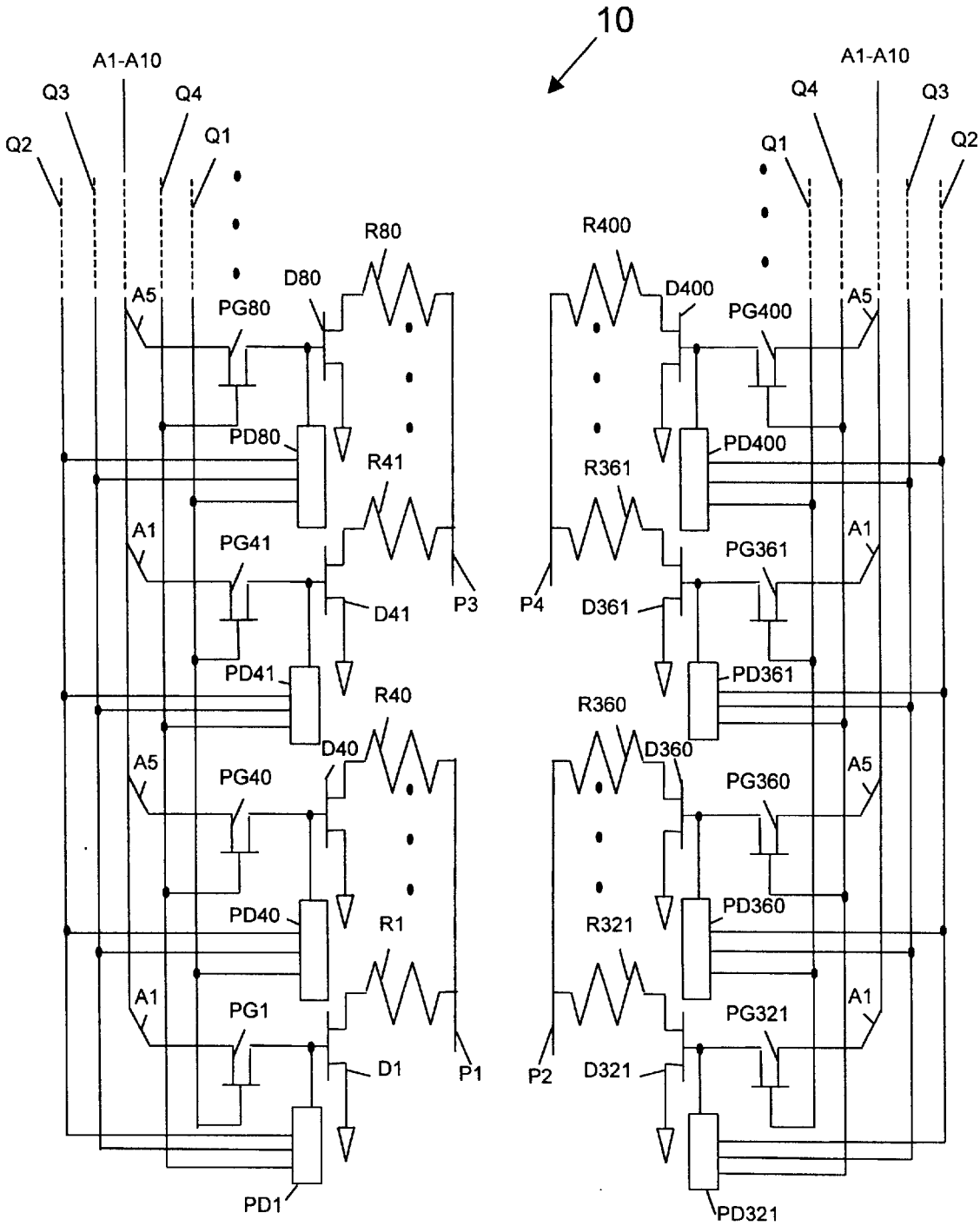
FIG. 3A is a schematic diagram of a preferred embodiment of a portion of an integrated control circuit, according to a preferred embodiment of the invention.
Figure 3B:
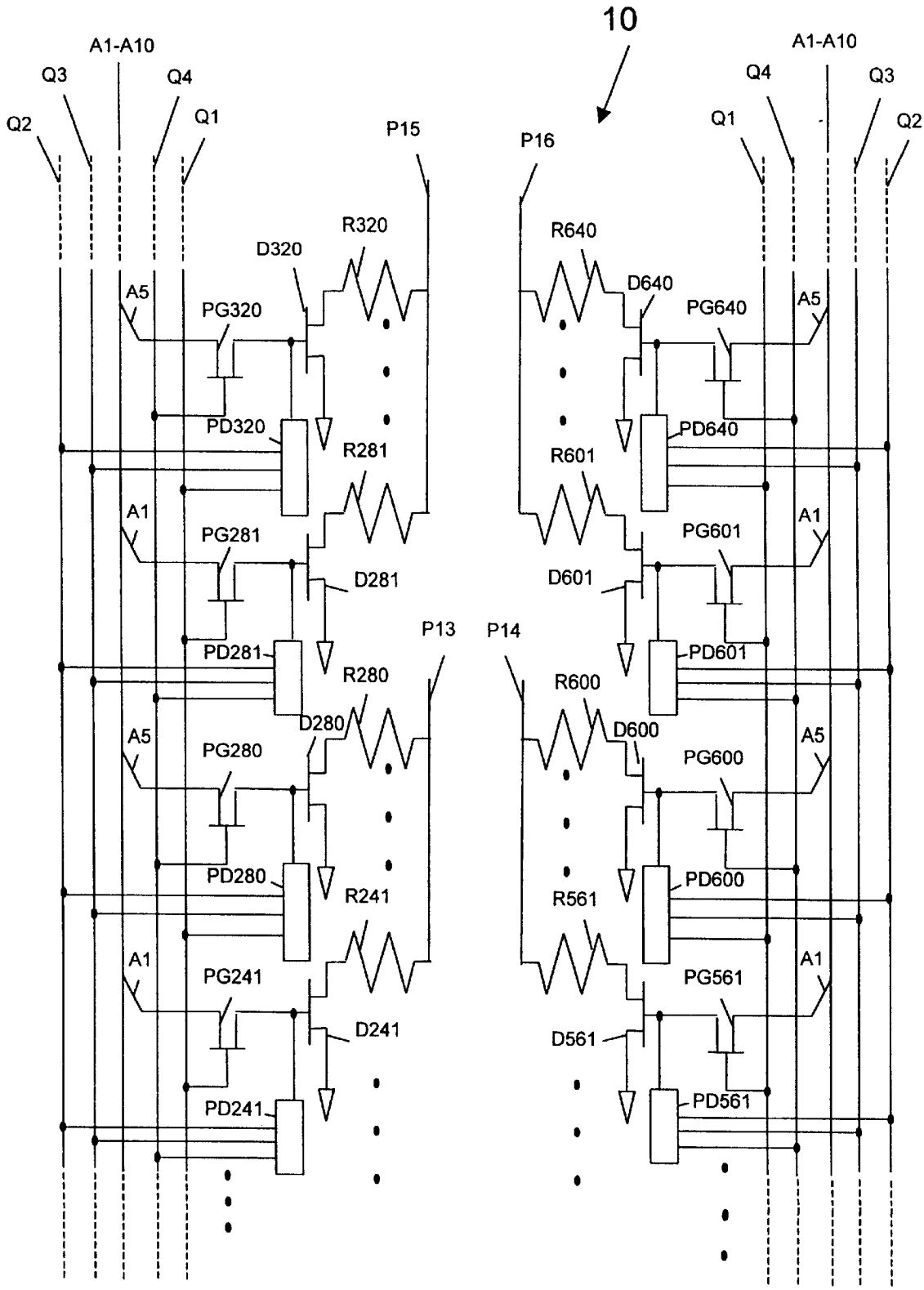
FIG. 3B is a schematic diagram of another portion of the integrated control circuit of FIG. 3A, according to a preferred embodiment of the invention.

According to the present invention, a novel printhead drive scheme is disclosed which utilizes the integrated control circuit 10 contained on the ink jet printhead 12 to generate a printed image on a print medium. As shown in FIGS. 3A and 3B, the preferred embodiment of the integrated control circuit 10 includes six hundred forty (640) of the resistive heating elements R1–R640. Based on the image data input to the printer controller 14, the controller 14 controls the activation of the resistive heating elements R1–R640. Once a resistive heating element R1–R640 is activated, ink adjacent to the resistive heating element R1–R640 is energized and expelled via the associated ink jet nozzles 18 onto a print medium, such as printer paper, thereby printing the desired image.

The ink jet printer prints an image based on image data input to the printer controller 14 which, in turn, transmits a plurality of control signals to the control circuit 10 located on the printhead 12. According to the invention, first, second and third control signals, also referred herein as address, quadrature, and primitive digital signals, respectively, delineate how the integrated control circuit 10 will function to control the output of the printhead 12. In a preferred embodiment of the present invention, the printer controller 14 sends the digital signals across the four quadrature lines Q1–Q4, ten address lines A1–A10, and sixteen primitive lines P1–P16 to the integrated circuit 10 located on the printhead 12, accounting for an addressing scheme capable of activating an array of six hundred forty (4×10×16=640) resistive heating elements.

Referring to Tables 1 and 2, a preferred embodiment of the three dimensional addressing scheme is shown. Table 1 illustrates the addressing scheme for the odd numbered circuitry elements, including address, quadrature and primitive control constituents. Table 2 illustrates the preferred addressing scheme for the even numbered circuitry components. Tables 1 and 2 taken together delineate a preferred addressing scheme for activating the resistive heating elements R1–R640, and thereby energizing the ink adjacent to the resistive heating elements R1–R640. Preferably, the resistive heating elements R1–R640 are arrayed in q number of subsets having a number of groups within each subset. Each group has p number of resistive heating elements which corresponding to the number of primitive lines. In the preferred embodiment, q is 4, a is 10, and p is 16.

TABLE 1

| | Q1 | | | | | | | | | | Q3 | | | | | | | | | |
|---|---|---|---|---|---|---|---|---|---|---|---|---|---|---|---|---|---|---|---|---|
| | A1 | A2 | A3 | A4 | A5 | A6 | A7 | A8 | A9 | A10 | A1 | A2 | A3 | A4 | A5 | A6 | A7 | A8 | A9 | A10 |
| P1 | 1 | 29 | 17 | 5 | 33 | 21 | 9 | 37 | 25 | 13 | 7 | 35 | 23 | 11 | 39 | 27 | 15 | 3 | 31 | 19 |
| P2 | 321 | 349 | 337 | 325 | 353 | 341 | 329 | 357 | 345 | 333 | 327 | 355 | 343 | 331 | 359 | 347 | 335 | 323 | 351 | 339 |
| P3 | 41 | 69 | 57 | 45 | 73 | 61 | 49 | 77 | 65 | 53 | 47 | 75 | 63 | 51 | 79 | 67 | 55 | 43 | 71 | 59 |
| P4 | 361 | 389 | 377 | 365 | 393 | 381 | 369 | 397 | 385 | 373 | 367 | 395 | 383 | 371 | 399 | 387 | 375 | 363 | 391 | 379 |
| P5 | 81 | 109 | 97 | 85 | 113 | 101 | 89 | 117 | 105 | 93 | 87 | 115 | 103 | 91 | 119 | 107 | 95 | 83 | 111 | 99 |
| P6 | 401 | 429 | 417 | 405 | 433 | 421 | 409 | 437 | 425 | 413 | 407 | 435 | 423 | 411 | 439 | 427 | 415 | 403 | 431 | 419 |
| P7 | 121 | 149 | 137 | 125 | 153 | 141 | 129 | 157 | 145 | 133 | 127 | 155 | 143 | 131 | 159 | 147 | 135 | 123 | 151 | 139 |

TABLE 1-continued

| | Q1 | | | | | | | | | | Q3 | | | | | | | | | |
|---|---|---|---|---|---|---|---|---|---|---|---|---|---|---|---|---|---|---|---|---|
| | A1 | A2 | A3 | A4 | A5 | A6 | A7 | A8 | A9 | A10 | A1 | A2 | A3 | A4 | A5 | A6 | A7 | A8 | A9 | A10 |
| P8 | 441 | 469 | 457 | 445 | 473 | 461 | 449 | 477 | 465 | 453 | 447 | 475 | 463 | 451 | 479 | 467 | 455 | 443 | 471 | 459 |
| P9 | 161 | 189 | 177 | 165 | 193 | 181 | 169 | 197 | 185 | 173 | 167 | 195 | 183 | 171 | 199 | 187 | 175 | 163 | 191 | 179 |
| P10 | 481 | 509 | 497 | 485 | 513 | 501 | 489 | 517 | 505 | 493 | 487 | 515 | 503 | 491 | 519 | 507 | 495 | 483 | 511 | 499 |
| P11 | 201 | 229 | 217 | 205 | 233 | 221 | 209 | 237 | 225 | 213 | 207 | 235 | 223 | 211 | 239 | 227 | 215 | 203 | 231 | 219 |
| P12 | 521 | 549 | 537 | 525 | 553 | 541 | 529 | 557 | 545 | 533 | 527 | 555 | 543 | 531 | 559 | 547 | 535 | 523 | 551 | 539 |
| P13 | 241 | 269 | 257 | 245 | 273 | 261 | 249 | 277 | 265 | 253 | 247 | 275 | 263 | 251 | 279 | 267 | 255 | 243 | 271 | 259 |
| P14 | 561 | 589 | 577 | 565 | 593 | 581 | 569 | 597 | 585 | 573 | 567 | 595 | 583 | 571 | 599 | 587 | 575 | 563 | 591 | 579 |
| P15 | 281 | 309 | 297 | 285 | 313 | 301 | 289 | 317 | 305 | 293 | 287 | 315 | 303 | 291 | 319 | 307 | 295 | 283 | 311 | 299 |
| P16 | 601 | 629 | 617 | 605 | 633 | 621 | 609 | 637 | 625 | 613 | 607 | 635 | 623 | 611 | 639 | 627 | 615 | 603 | 631 | 619 |

TABLE 2

| | Q2 | | | | | | | | | | Q4 | | | | | | | | | |
|---|---|---|---|---|---|---|---|---|---|---|---|---|---|---|---|---|---|---|---|---|
| | A1 | A2 | A3 | A4 | A5 | A6 | A7 | A8 | A9 | A10 | A1 | A2 | A3 | A4 | A5 | A6 | A7 | A8 | A9 | A10 |
| P1 | 2 | 30 | 18 | 6 | 34 | 22 | 10 | 38 | 26 | 14 | 8 | 36 | 24 | 12 | 40 | 28 | 16 | 4 | 32 | 20 |
| P2 | 322 | 350 | 338 | 326 | 354 | 342 | 330 | 358 | 346 | 334 | 328 | 356 | 344 | 332 | 360 | 348 | 336 | 324 | 352 | 340 |
| P3 | 42 | 70 | 58 | 46 | 74 | 62 | 50 | 78 | 66 | 54 | 48 | 76 | 64 | 52 | 80 | 68 | 56 | 44 | 72 | 60 |
| P4 | 362 | 390 | 378 | 366 | 394 | 382 | 370 | 398 | 386 | 374 | 368 | 396 | 384 | 372 | 400 | 388 | 376 | 364 | 392 | 380 |
| P5 | 82 | 110 | 98 | 86 | 114 | 102 | 90 | 118 | 106 | 94 | 88 | 116 | 104 | 92 | 120 | 108 | 96 | 84 | 112 | 100 |
| P6 | 402 | 430 | 418 | 406 | 434 | 422 | 410 | 438 | 426 | 414 | 408 | 436 | 424 | 412 | 440 | 428 | 416 | 404 | 432 | 420 |
| P7 | 122 | 150 | 138 | 126 | 154 | 142 | 130 | 158 | 146 | 134 | 128 | 156 | 144 | 132 | 160 | 148 | 136 | 124 | 152 | 140 |
| P8 | 442 | 470 | 458 | 446 | 474 | 462 | 450 | 478 | 466 | 5 | 448 | 476 | 464 | 452 | 480 | 468 | 456 | 444 | 472 | 460 |
| P9 | 162 | 190 | 178 | 166 | 194 | 182 | 170 | 198 | 186 | 17 | 168 | 196 | 184 | 172 | 200 | 188 | 176 | 164 | 192 | 180 |
| P10 | 482 | 510 | 498 | 486 | 514 | 502 | 490 | 518 | 506 | 49 | 448 | 516 | 504 | 492 | 520 | 508 | 496 | 484 | 512 | 500 |
| P11 | 202 | 230 | 218 | 206 | 234 | 222 | 210 | 238 | 226 | 214 | 208 | 236 | 224 | 212 | 240 | 228 | 216 | 204 | 232 | 220 |
| P12 | 522 | 550 | 538 | 526 | 554 | 542 | 530 | 558 | 546 | 534 | 528 | 556 | 544 | 532 | 560 | 548 | 536 | 524 | 552 | 540 |
| P13 | 242 | 270 | 258 | 246 | 274 | 262 | 250 | 278 | 266 | 254 | 248 | 276 | 264 | 252 | 280 | 268 | 256 | 244 | 272 | 260 |
| P14 | 562 | 590 | 57 | 566 | 594 | 582 | 570 | 598 | 586 | 574 | 568 | 596 | 584 | 572 | 600 | 588 | 576 | 564 | 592 | 580 |
| P15 | 282 | 310 | 298 | 286 | 314 | 302 | 290 | 318 | 306 | 294 | 288 | 316 | 304 | 292 | 320 | 308 | 296 | 284 | 312 | 300 |
| P16 | 602 | 630 | 616 | 606 | 634 | 622 | 610 | 638 | 626 | 614 | 608 | 636 | 624 | 612 | 640 | 628 | 616 | 604 | 632 | 620 |

Thus, according to a preferred embodiment of the invention, there are four subsets of heating elements and associated switching devices corresponding to the four quadrature control lines Q1–Q4. Ten groups of resistive heating elements R1–R640 within each subset correspond to the ten address control lines A1–A10. Each group includes sixteen of the resistive heating elements R1–R640 associated with sixteen primitive lines P1–P16. Correspondingly, there are forty of the resistive heating elements R1–R640 associated with each of the sixteen primitive lines P1–P16.

Figure 5:
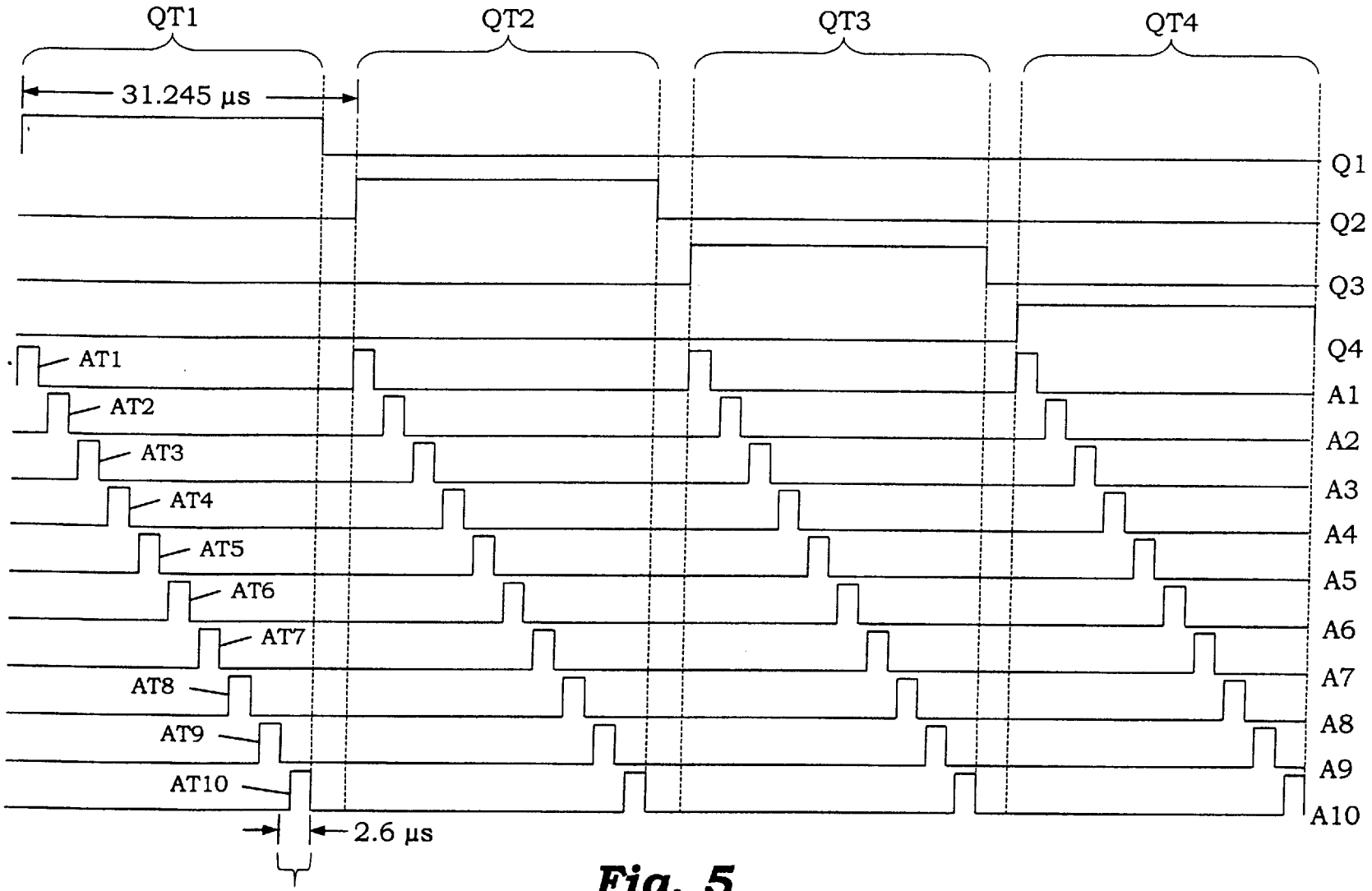
FIG. 5 depicts a control signal timing diagram according to a preferred embodiment of the invention.

Referring now to the control timing diagram of FIG. 5, during each of four sequential quad intervals QT1–QT4 when a high signal is transmitted across the quad lines Q1–Q4, the controller 14 is capable of causing all or just a portion of the signals transmitted across the sixteen primitive control lines P1–P16 to have a high state by sending a corresponding primitive signal to the printhead 12. Within each of the four quad intervals QT1–QT4, there are ten sequential addressing intervals AT1–AT10. During each address interval AT1–AT10, the address lines A1–A10 transmit high address signals to the control circuit 10. For example, during the QT1 interval, one to sixteen primitive control signals may have a high state during any one of the addressing intervals AT1–AT10, depending upon the image data input to the printer controller 14. Utilizing this three dimensional addressing scheme, the printer controller 14 selectively enables the printhead 12 to vary the nozzle output, from one to sixteen nozzles, based upon the number high primitive signals transmitted across primitive lines P1–P16.

As shown in FIGS. 3A and 3B, the preferred embodiment of the invention includes the six hundred forty (640) power switching devices D1–D640, each connected to a corresponding one of the resistive heating elements R1–R640 and to a corresponding one of the pass switching devices PG1–PG640. The pass switching devices PG1–PG640 and the power switching devices D1–D640 are preferably transistors, each having a source, drain and gate connections. In the preferred embodiment of the invention, each power switching device D1–D640 is a low-side NMOS power transistor. The drains of the power switching devices D1–D640 are electrically connected to the low side of an associated resistive heating element R1–R640. Correspondingly, the sources of the power switching devices D1–D640 are preferably connected to a common ground return. The gate of each power switching device D1–D640 is electrically connected to the source of an associated one of the pass switching devices PG1–PG640. The high side of each of the resistive heating elements R1–R640 is electrically connected to an associated primitive select line P1–P16.

Figure 4:
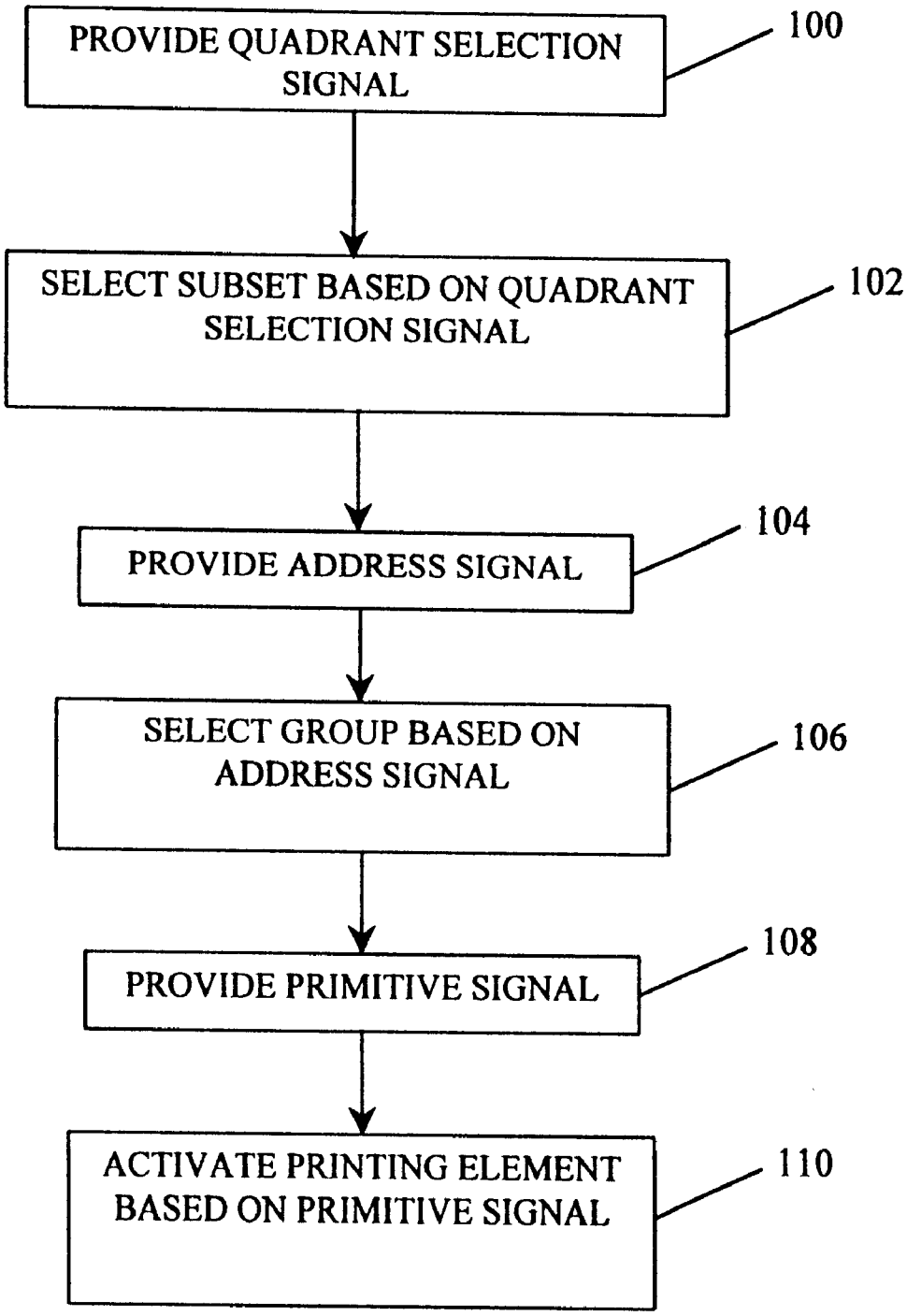
FIG. 4 depicts a method of controlling an ink jet printhead, according to a preferred embodiment of the invention.

With reference to FIGS. 3A and 3B, in a preferred embodiment of the invention, one end of each quad line Q1–Q4 is electrically connected to a corresponding gate of the pass switching devices PG1–PG640. The opposite end of each quad line Q1–Q4 is electrically connected to the printer controller 14. As shown in FIGS. 4 and 5, during intervals QT1–QT4, each quad line Q1–Q4 provides a high quad signal (steps 100 and 102 of FIG. 4) to the gates of the pass switching devices PG1–PG640 in the corresponding one of the four of subsets.

Referring to the timing control diagram in FIG. 5, the quadrature lines Q1–Q4 are activated sequentially, and each quad line Q1–Q4 is preferably activated for a duration of about 31.245 microseconds. Each quad line Q1–Q4 transmits a quad signal which selectively enables the activation of a×p number of the resistive heating elements R1–R640 within the corresponding subset (preferably 160 resistive heating elements). That is, each quad line Q1–Q4 is electrically connected to the gate of a predetermined pass switching device PG1–PG640, thereby providing a high quad signal to the corresponding gate when each of the quad lines Q1–Q4 are activated by the printer controller 14. According to the timing diagram of FIG. 5, one hundred sixty (160) gates of the pass switching devices PG1–PG640 have a high input upon activation of each of the first control lines Q1–Q4.

Preferably there are ten address lines A1–A10, the address lines being constituent to a common bus, accounting for ten groups of potential activation selections of the resistive heating elements R1–R640 within each of the four subsets Q1–Q4 (see Tables 1 and 2). One end of each address line A1–A10 is electrically connected to a drain of a predetermined pass switching device PG1–PG640 and the opposite end of each address line A1–A10 is electrically connected to the printer controller 14. During the intervals QT1–QT4 when the quad lines Q1–Q4 are sending high signals, the pass switching devices PG1–PG640 are turned "on" and operate like a closed switch connecting the drain to the source.

During each group address interval AT1–AT10, the address lines A1–A10 are transmitting high address signals to the drains of the pass switching devices PG1–PG640 (steps 104 and 106 of FIG. 4) and when the pass switching devices PG1–PG640 are closed (or "on") during each quad interval QT1–QT4, the corresponding address signal passes from the drain to the source of the respective pass switching devices PG1–PG640. Since each source of the pass switching devices PG1–PG620 is electrically connected to a corresponding gate of the power switching devices D1–D640, the address signal turns "on" or closes the power switching device, thereby creating a current path between the drain of the power switching device D1–D640 and the respective resistive heating element R1–R640. Moreover, during each address interval AT1–AT10 there are sixteen potential resistive heating elements that may be activated (Tables 1 and 2), resulting to a high degree of freedom during printing applications. Referring to the timing diagram of FIG. 5, the printer controller 14 cycles through the individual address lines A1–A10, during the quad intervals QT1–QT4 when each quad line Q1–Q4 is transmitting a high quad signal. During each quad interval QT1–QT4, each address line A1–A10 sequentially provides a high input signal to the drains of the pass switching devices PG1–PG640. Each address signal A1–A10 preferably has an associated address interval AT1–AT10 duration of about 2.6 microseconds.

As best shown in FIGS. 3A and 3B, and Tables 1 and 2, the invention preferably includes sixteen primitive lines P1–P16, equaling the number of circuitry components within each of the forty groups. Preferably, one end of each of the primitive lines P1–P16 is electrically connected to the high sides of forty (40) of the resistive heating elements R1–R640, and the opposite ends are electrically connected to the printer controller 14. The printer controller 14, according to the inputted image data to the controller 14, controls the activation of the primitive lines P1–P16. Each primitive line P1–P16 provides a primitive control signal (step 108 of FIG. 4) which accounts for the third signal dimension of the addressing scheme. Each primitive line P1–P16 is capable of activating forty resistive heating elements by sending a high primitive signal (step 110 of FIG. 4) at any one time based upon activation intervals of the quad and address lines Q1–Q4 and A1–A10, respectively. That is, each primitive line P1–P16 is electrically connected to forty resistive heating elements, such that the address and quadrature intervals AT1–AT10 and QT1–QT4, respectively, may be adjusted according to the preferred print capability or specific application criterion.

As described above, the printer controller 14 is capable of selectively activating any one of the 640 resistive heating elements R1–R640 based upon the quad Q1–Q4, address A1–A10 and primitive P1–P16 control signal transmissions. For example, based upon the timing diagram of FIG. 5 and Table 2, to activate resistive heating element R620, quad line Q4 is transmitting a high quad signal and address line A10 is also transmitting a high address signal. Based on the image data input and the desire to energize resistive heating element R620, the printer controller 14 activates primitive line P16, sending a high signal to the high side of resistor R620. More particularly, to energize resistive heating element R620, printer controller 14 activates quad line Q4 to provide a high quad signal to the gate of pass switching device PG620, thereby providing a current path from the drain to the source of pass switching device PG620. The printer controller 14 also activates address line A10 providing a high address signal to the drain of pass switching device PG620 which proceeds to the source of pass switching device PG620, thereby providing a high address signal to the gate of power switching device D620. The high address signal input to the gate of power switching device D620 turns on the device, thereby creating a current path from the drain, which is connected to resistive heating element R620, to the source, which is connected to a common ground. Resistive heating element R620 is energized when the printer controller 14 activates primitive line P16, transmitting a high primitive signal to the high side of resistive heating element R620, and thereby completing the circuit. That is, because the source of the power switching device D620 is electrically connected to ground, the closed switch (D620) operates to connect the low side of resistive heating element R620 to ground, thereby activating resistive heating element R620, and energizing the ink adjacent to the resistive heating element R620. The energized ink adjacent to resistive heating element R620 is caused to expel out of the corresponding nozzle 18 and onto the print medium.

Figure 3C:
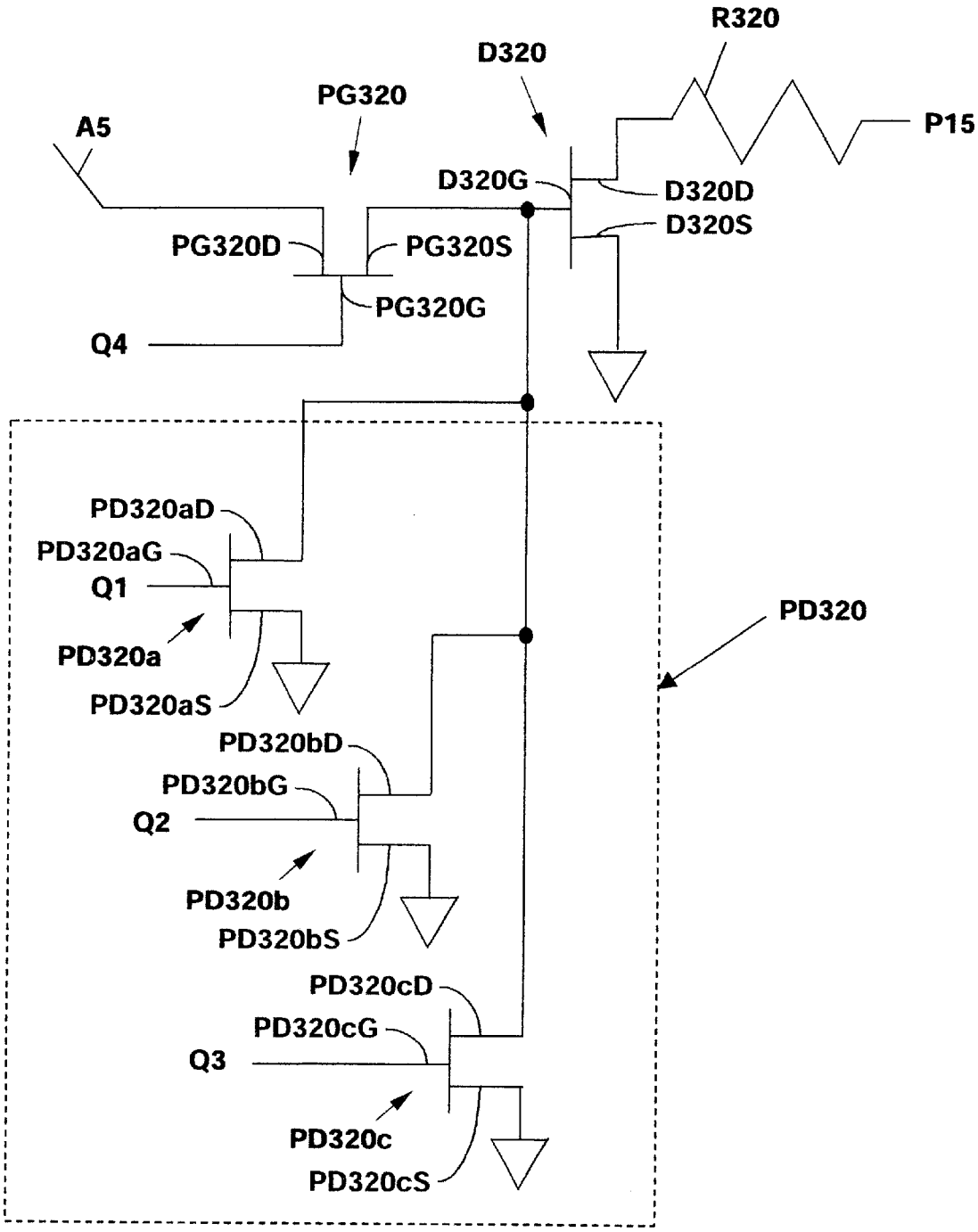
FIG. 3C is a schematic diagram of a pull down circuit of the integrated control circuit of FIG. 3B.

Referring to FIGS. 3A and 3B, there are q×a×p number, preferably six hundred forty (640), of the pull down switching circuits PD1–PD640 located on the integrated control circuit 10. Preferably the number of pull down switching circuits PD1–PD640 equals the number of pass and power switching devices. As shown in FIG. 3C, each pull down switching circuit PD1–PD640, such as the pull down switching circuit PD320, includes three pull down devices or pull down switching devices PD1*a,b,c*–PD640*a,b,c*. According to a preferred embodiment of the invention, the pull down switching devices PD1*a,b,c*–PD640*a,b,c* are transistors, each having a source, drain and gate. For example, as shown in FIG. 3C, the pull down switching device PD320*a* has a source PD320*a*S, a drain PD320*a*D, and a gate PD320*a*G. Similarly, the pull down switching device PD320*b* has a source PD320*b*S, a drain PD320*b*D, and a gate PD320*b*G, and the pull down switching device PD320*c* has a source PD320*c*S, a drain PD320*c*D, and a gate PD320*c*G. The gates of each of the pull down switching devices PD1*a,b,c*–PD640*a,b,c*, such as the gates PD320*a*G, PD320*b*G, and PD320*c*G, are electrically connected to q−1 (preferably three) of the quad lines Q1–Q4. More particularly, the gate of each pull down switching device PD1*a,b,c*–PD640*a,b,c* is not connected to the quad line Q1–Q4 that is connected to the gate of the common pass switching device PG1–PG640 within the common sub-circuit driving a particular resistive heating element R1–R640.

For example, as shown in FIG. 3C, the Q4 line is electrically connected to the gate PD320G of pass switching device PG320, and is not connected to the gates PD320*a*G, PD320*b*G, and PD320*c*G of pull down switching devices PD320*a*–PD320*c*. Moreover, only one of the quad lines Q1–Q4 is electrically connected to each pass switching device PG1–PG640, whereas three of the quad lines Q1–Q4 are electrically connected to the respective pull down switching devices PD1*a,b,c*–PD640*a,b,c*. Therefore, for the example above, the gates PD320*a*G, PD320*b*G, and PD320*c*G of the pull down switching devices PD320*a*–PD320*c* are electrically connected to quad lines Q1, Q2 and Q3, respectively. The gates of the pull down switching devices PD1*a,b,c*–PD640*a,b,c* are electrically connected to specific quad inputs, as described above. The sources of the pull down switching devices PD1*a,b,c*–PD640*a,b,c*, such as the sources PD320*a*S, PD320*b*S, and PD320*c*S, are electrically connected to a common ground, and the drains, such as the drains PD320*a*D, PD320*b*D, and PD320*c*D, are electrically connected between the sources of the pass switching devices PG1–PG640 and the gates of the power switching devices D1–D640, such as between the source PG320S and the gate D320G as shown in FIG. 3C.

The pull down switching devices PD1*a,b,c*–PD640*a,b,c* are activated when an associated quad line Q1–Q4 is active. The pull down switching devices PD1*a,b,c*–PD640*a,b,c* help to minimize any capacitive interference effects which could potentially cause a resistive heating element to energize at the wrong time. To prevent such an unwanted occurrence, the pull down switching devices PD1*a,b,c*–PD640*a,b,c* operate to "pull down" to ground the gates D1G–D640G of the corresponding power switching devices D1–D640. This "pull down" strategy effectively eliminates potential neighboring capacitance effects, thereby preventing erroneous nozzle firing. For example, when the Q1, Q2, and Q3 lines are transmitting a high quad signal, the drains PD320*a*D, PD320*b*D, and PD320*c*D of the pull down switching devices PD320*a*–PD320*c* pull down the gate D320G of the power switching device D320 to ground, thus preventing resistive heating element R320 from erroneously energizing during active quad line intervals QT1, QT2, and QT3.

Figure 6:
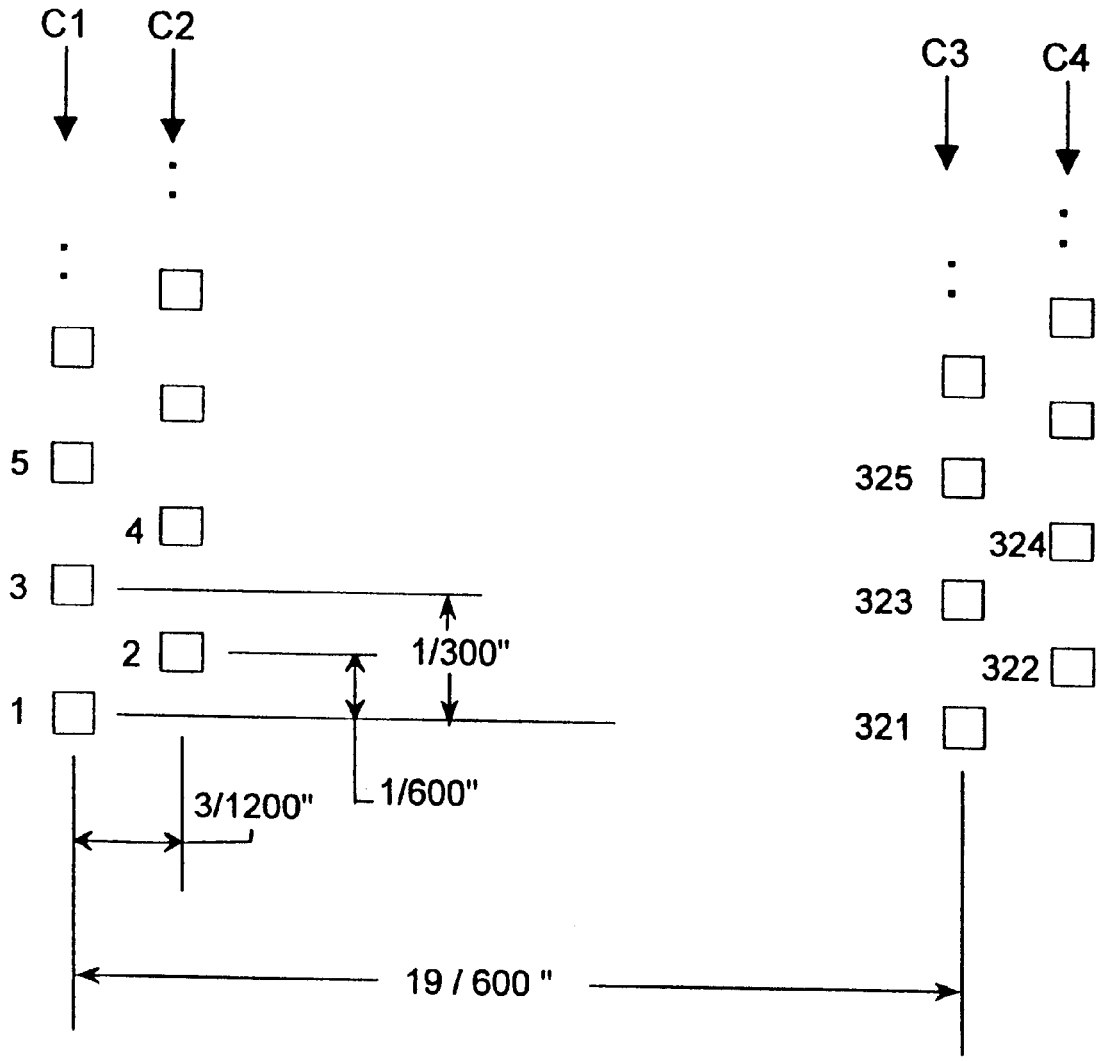
FIG. 6 depicts a configuration of ink-heating resistors on a print head chip according to a preferred embodiment of the invention.

Referring to FIG. 6, a preferred resistive heating element R1–R640 architecture is shown. According to Tables 1 and 2, the first and third subsets of odd-numbered resistive heating elements R1–R639 are arranged in a first column C1 and a third column C3 on the integrated control circuit 10. Correspondingly, the second and fourth subsets of even-numbered resistive heating elements R2–R640 are arranged in second column C2 and a fourth column C4 on the circuit 10. Preferably, the resistive heating elements in the first column C1 are vertically offset from the resistive heating elements in the second column C2 by a vertical offset distance of about one six-hundredth (1/600) of an inch, and the resistive heating elements in the third column C3 are vertically offset from the resistive heating elements in the fourth column C4 by about the same vertical offset distance. The vertical offset distance between the resistive heating elements located in the same column is about one three-hundredth (1/300) of an inch.

In the preferred embodiment, the first column C1 and second column C2 of resistive heating elements are horizontally separated by a first horizontal offset distance of about three twelve-hundredth (3/1200) of an inch, and the third column C3 and fourth column C4 are horizontally separated by about the same horizontal offset distance. Preferably, the first column C1 and third column C3 are horizontally separated by a second horizontal offset distance of about nineteen six-hundredth (19/600) of an inch. Correspondingly, the first horizontal offset distance is preferably an odd multiple of one half the vertical offset distance.

Referring again to FIGS. 3A and 3B, the addressing scheme and control circuit 10 enables the printhead 12 to print a high density image without multiple printhead 12 passes. That is, according to the preferred scheme, it is possible to print an image which normally would require two passes of the printhead 12, to be accomplished with only a single pass of the printhead 12. For example, with reference to Table 2, during the QT1 and AT1 intervals when the A1 and Q1 lines are transmitting high signals, activating primitive lines P1 and P2 enables twice the amount of ink to be ejected along the same print line, since resistive heating elements R1 and R321 activate substantially simultaneously along the same print line or row (FIG. 6). Similarly, resistive heating elements R2 and R322 may activate substantially simultaneously during quad interval QT2, and address interval AT1, when the primitive signals transmitted across the primitive lines P1 and P2 are high. Furthermore, the addressing scheme according to the invention allows for the activation of a variable range of resistive heating elements from a maximum of sixteen resistive heating elements to a minimum of one resistive heating element at any time without having to switch ground connections, which provides for optimal print control based upon the inputted image data and user requirements.

Having described various aspects and embodiments of the invention, and several advantages thereof, it will be recognized by those of ordinary skills that the invention is susceptible to various modifications, substitutions and revisions within the spirit and scope of the appended claims. For example, the invention is not limited to any particular number of quadrature lines, address lines, or primitive lines. Furthermore, the invention is not limited to any number of resistive heating elements, switching devices or printing elements.

What is claimed is:

1. A method of selectively activating a printing element within an array of printing elements on a printhead of an ink jet printer, the method comprising the steps of:

(a) providing a plurality of printing elements, each printing element having an associated pass-gate device and power device, each pass-gate device and power device having a source, drain, and gate, where the source of each pass-gate device is connected to the gate of a corresponding one of the power devices, and where the source of each power device is connected to a corresponding one of the printing elements, (b) defining a plurality of subsets of printing elements and associated pass-gate and power devices, (c) providing a quadrant selection signal to the pass-gate devices of a selected one of the subsets to thereby select a subset of printing elements in the array of printing elements based on the quadrant selection signal, (d) defining a plurality of groups of printing elements and associated pass-gate devices and power devices within each subset, (e) providing an address signal to a selected group of the power devices within the selected subset to thereby select a group of printing elements based on the address signal, (f) providing a primitive signal to the selected group of printing elements on the printhead, and (g) activating a selected printing element within the selected group based on the primitive signal.

2. The method of claim 1, wherein:

step (c) includes providing the quadrant selection signal to the gates of the pass-gate devices within the subset and setting the quadrant selection signal high on the gates of the pass-gate devices within the subset, step (f) includes providing the address signal to the drains of the pass-gate devices within the group and setting the address signal high on the drains of the pass-gate devices within the group, and step (g) includes setting the primitive signal high on the printing element.

3. The method of claim 2 further comprising grounding the gates of the power devices which are not in the group of power devices selected in step (f).

4. An integrated circuit on an ink jet printhead for generating a printed image on a print medium based on a first, second, and third control signal from a printer controller, the integrated circuit comprising:

an array of q×a×p number of resistive heating elements for heating adjacent ink and thereby causing the ink to be expelled onto the print medium, the resistive heating elements in q number of subsets and a number of groups within each subset, there being p number of resistive heating elements within each group, q×a×p number of power switching devices, each connected to a corresponding one of the resistive heating elements, q×a×p number of pass switching devices, each connected to a corresponding one of the power switching devices, q number of first control lines corresponding to the q number of subsets, each first control line connected to and providing the first control signal to a corresponding one of the q number of subsets of the pass switching devices, the first control signal for selectively enabling activation of the q×p number of resistive heating elements within the corresponding subset, a number of second control lines corresponding to the a number of groups within each subset, each second control line connected to and providing the second control signal to a corresponding one of the a number of groups of the pass switching devices, the second control signal for selectively enabling activation of the p number of resistive heating elements with the corresponding group, p number of third control lines corresponding to the p number of resistive heating elements within each group, each third control line connected to and providing the third control signal to a corresponding one of the p number of resistive heating elements within the corresponding group, the third control signal for selectively activating one of the p number of resistive heating elements, and each pass switching device for providing the second control signal to the corresponding power switching device based upon the corresponding first control signal.

5. The integrated circuit of claim 4, further comprising:

each pass switching device having a pass gate, a pass source and a pass drain, each power switching device having a power gate, a power source and a power drain, the pass gate of each pass switching device electrically connected to a corresponding one of the first control lines, the pass drain of each pass switching device electrically connected to a corresponding one of the second control lines, the pass source of each pass switching device electrically connected to a corresponding one of the power gates of the power switching devices, the power drain of each power switching device electrically connected to one side of a corresponding one of the resistive heating elements, and the power source of each power switching device electrically connected to a common ground return.

6. The integrated circuit of claim 5 further comprising:

each pass switching device for providing the second control signal from the pass drain to the pass source to the power gate of the connected power switching device when the first control signal is high on the pass gate of the pass switching device, each power switching device for connecting the one side of the corresponding resistive heating element to the common ground return when the second control signal is high on the power gate of the power switching device, and each resistive heating element for generating heat in adjacent ink and thereby causing ink to expel onto the print medium when the one side of the resistive heating element is connected to the common ground return and the third control signal is high on the other side of the resistive heating element.

7. The integrated circuit of claim 5 further comprising pull-down circuits, wherein each pull-down circuit includes a plurality of pull-down switching devices each having a pull-down gate connected to q−1 number of the first control lines, a pull-down source connected to the common ground return, and a pull-down drain connected to the power gate of a corresponding one of the power switching devices, the pull-down switching devices for connecting the power gate of the corresponding one of the power switching devices to the common ground return when the first control signal on any of the q−1 number of the first control lines is high.

8. The integrated circuit of claim 4 wherein q is four, and the array of resistive heating elements are divided into first, second, third, and fourth subsets, the first and third subsets arranged in first and third columns on the printhead integrated circuit and the second and fourth subsets arranged in second and fourth columns on the printhead integrated circuit.

9. The integrated circuit of claim 8 wherein the resistive heating elements in the first column are vertically offset from the heating resistive elements in the second column by a vertical offset distance, and the resistive heating elements in the third column are vertically offset from the resistive heating elements in the fourth column by the vertical offset distance.

10. The integrated circuit of claim 9 wherein the first and second columns are horizontally separated by a first horizontal offset distance, the third and fourth columns are horizontally separated by the first horizontal offset distance, and the first and third columns are horizontally separated by a second horizontal offset distance.

11. The integrated circuit of claim 10 wherein the first horizontal offset distance is an odd multiple of one half the vertical offset distance.

12. The integrated circuit of claim 11 wherein the first horizontal offset distance is approximately 3/1200th inch, the second horizontal offset distance is approximately 19/600th inch, and the vertical offset distance is approximately 1/600th inch.

13. An ink jet printing apparatus for generating a printed image on a print medium, the apparatus comprising:

an array of resistive heating elements for heating adjacent ink and thereby causing the ink to be expelled onto the print medium, subset selection means for selecting a subset of the resistive heating elements to be activated based on subset selection signals, group selection means for selecting a group of the resistive heating elements within the selected subset to be activated based on group selection signals, primitive selection means for providing primitive selection signals to resistive heating elements within the selected group, where the primitive selection signals activate individual resistive heating elements within the selected group, power switching devices for controlling activation of corresponding resistive heating elements based on the group selection signals, and pass switching devices for providing the group selection signals to corresponding power switching devices based on the subset selection signals.

14. The apparatus of claim 13 further comprising:

each pass switching device having a pass gate, a pass source and a pass drain.

each power switching device having a power gate, a power source and a power drain, the pass gate of each pass switching device electrically connected to the subset selection means, the pass drain of each pass switching device electrically connected to the group selection means, the pass source of each pass switching device electrically connected to a corresponding one of the power gates of the power switching devices, the power drain of each power switching device electrically connected to one side of a corresponding one of the resistive elements, and the power source of each power switching device electrically connected to a common ground return.

15. The apparatus of claim 14 further comprising each pass switching device for providing the group selection signal from the pass drain to the pass source to the power gate of the connected power switching device when the subset selection signal is high on the pass gate of the pass switching device, each power switching device for connecting the one side of the corresponding resistive heating element to the common ground return when the group selection signal is high on the power gate of the power switching device, and each resistive heating element for generating heat in the adjacent ink and thereby causing ink to expel onto the print medium when the one side of the resistive heating element is connected to the common ground return and the primitive selection signal is high on the other side of the resistive heating element.

16. The apparatus of claim 14 further comprising pull-down circuits, wherein each pull-down circuit includes a plurality of pull-down switching devices each having a pull-down gate connected to the subset selection means, a pull-down source connected to the common ground return, and a pull-down drain connected to the power gate of a corresponding one of the power switching devices, the pull-down switching devices for connecting the power gate of the corresponding one of the power switching devices to the common ground return when a subset selection signal is high.

17. The apparatus of claim 13 wherein the array of resistive heating elements are divided into first, second, third and fourth subsets, with the first and third subsets arranged in first and third columns, and with the second and fourth subsets arranged in second and fourth columns.

18. The apparatus of claim 17 wherein the resistive heating elements in the first column are vertically offset from the heating resistive elements in the second column by a vertical offset distance, and the resistive heating elements in the third column are vertically offset from the resistive heating elements in the fourth column by the vertical offset distance.

19. The apparatus of claim 18 wherein the first and second columns are horizontally separated by a first horizontal offset distance, the third and fourth columns are horizontally separated by the first horizontal offset distance, and the first and third columns are horizontally separated by a second horizontal offset distance.

20. The apparatus of claim 19 wherein the first horizontal offset distance is an odd multiple of one half the vertical offset distance.

* * * * *